US006032499A

United States Patent [19]

Juillerat et al.

[11] Patent Number: 6,032,499

[45] Date of Patent: Mar. 7, 2000

[54] DEVICE FOR LIFTING A BAN ON THE OPENING OF A CONDITIONAL LOCKING SYSTEM

[75] Inventors: Denis Juillerat; Pierre Pellaton, both of Le Locle, Switzerland

[73] Assignee: Ilco-Unican S.A., La Chaux-de-fonds, Switzerland

[21] Appl. No.: 09/084,984

[22] Filed: May 28, 1998

[30] Foreign Application Priority Data

May 30, 1997 [EP] European Pat. Off. ..... 97108690

[51] Int. Cl.[7] ..... E05B 43/00

[52] U.S. Cl. ..... 70/267; 70/271; 70/278.1; 340/825.31

[58] Field of Search ..... 70/267–274, 278.1–278.7; 340/825.31

[56] References Cited

U.S. PATENT DOCUMENTS

| | | | |
|---|---|---|---|
| 2,073,523 | 3/1937 | Meilink | 70/272 X |
| 2,191,694 | 2/1940 | Hirn | 70/274 |
| 3,576,119 | 4/1971 | Harris | 70/271 |
| 3,881,171 | 4/1975 | Moorman et al. | 70/271 X |
| 3,950,678 | 4/1976 | Brewer | 70/271 X |
| 4,137,738 | 2/1979 | Marold | 70/274 |
| 4,633,687 | 1/1987 | Fane | 70/276 |
| 4,634,846 | 1/1987 | Harvey et al. | 340/825.31 X |
| 4,774,512 | 9/1988 | Jolidon et al. | 70/272 X |
| 4,944,170 | 7/1990 | Jolidon et al. | 70/267 |
| 4,977,765 | 12/1990 | Legault et al. | 70/271 X |
| 5,307,655 | 5/1994 | Boltz et al. | 70/267 X |
| 5,638,712 | 6/1997 | Kuroda | 70/271 X |
| 5,774,066 | 6/1998 | Pellaton et al. | 70/272 X |

FOREIGN PATENT DOCUMENTS

| | | |
|---|---|---|
| 256430 | 2/1988 | European Pat. Off. . |
| 89 14 267 | 5/1990 | Germany . |

*Primary Examiner*—Suzanne Dino Barrett
*Attorney, Agent, or Firm*—Sughrue, Mion, Zinn, Macpeak & Seas, PLLC

[57] ABSTRACT

A device for lifting, in particular in the event of a breakdown or failure, the ban on the opening of a conditional opening locking system. This device includes: driving means (MT); a transmission member (28); and a blocking member (PVI) connected to the driving means (MT) by the transmission member (28) and able to be actuated by the driving means (MT) to occupy an active position (P1) in which the blocking member opposes the movement of a bar, and an inactive position (P2) in which the blocking member authorizes the movement thereof, the device including de-activation means (54, 64, 66) provided for freeing the transmission member (28) and authorizing the release of the blocking member (PVI) from the blocking member's active position (P1). The device is applicable in particular to a conditional opening locking system and particularly to a time lock.

24 Claims, 10 Drawing Sheets

TGI
C
66
50
54
34
MT
44
32
10
36
26b
C
28
26a
56
52
X1
42
64
56b
40
46
48
26
X2

X2
60
X1
10

38
32
42
62
TGI
36
58
56b
26b
64
26
54
52
48b
46
48
12
X3

DEVICE FOR LIFTING A BAN ON THE OPENING OF A CONDITIONAL LOCKING SYSTEM

BACKGROUND OF THE INVENTION

The present invention concerns a device for lifting, in particular in the event of a breakdown of failure, the ban on the opening of a conditional opening locking system.

More particularly, the invention relates to the application of this device to a high security time-lock locking system, for controlling, over determined periods of time, access to high security enclosures, such as for example bank safes and strongrooms.

Such a device and time-lock locking system of this type are described in EP Patent No 0 256 430 (corresponding to U.S. Pat. No. 4,944,170-Jolidon et. al).

A security mechanism described in this Patent Document and incorporating this device and locking system, is shown very schematically in FIG. 1.

As described in this Patent Document and as shown in this Figure, the locking of a door PO of a safe or any other high security enclosure (this door being seen from inside in FIG. 1), is generally made, via several bolts or latch bolts PT controlled by a rod assembly TR, said rod assembly being able to be moved, by an operator, via a hand wheel VO, from a latching position to an unlatched position and vice versa.

Rod assembly includes for this purpose a bar B which controls the movement of bolts PT of door PO and which is coupled to hand wheel VO, via a mechanism of the rack and pinion type.

This bar B can be moved, in translation, by the action of hand wheel VO, to order the movement of bolts PT and to assure the latching (bolts withdrawn) and unlatching (bolts pushed in) operations.

In order to prevent the unlocking of door PO and hold rod assembly TR in the latching position when bolts PT are in this position, this assembly includes a first lock S which is itself provided with a bolt PS provided for engaging in bar B. Bolt PS is thus provided for blocking the translation movement of bar B.

This first lock S can be controlled, in the simplest version by a key, or even by more sophisticated means, such as a magnetic card, a smart card or an electronic system operating with a code or any other type of access authorization.

However, in order to raise the level of security and to prevent any fraudulent use of this first lock S, a second lock SH called the time lock is associated therewith.

This time lock SH also includes its own bolt PV, which is called more generally a latch or blocking member and which is provided for being placed on the path of bar B, in order to impede the movement thereof into its unlatched position. In the raised position of blocking member PV shown in FIG. 1, bar B thus abuts member PV with its rear end.

Blocking member PV is associated, in this time lock SH, with a driving assembly EM, including in particular an electromagnetic motor and a cam and lever mechanism (not shown).

This driving assembly EM can be controlled by electronic means EL associated with peripheral display means PA and data input means ED used for programming the periods of time. Peripheral means PA and ED are formed, in this example, by a digital display and a keyboard. Electronic means EL include a microprocessor MP and a memory MM of the RAM/ROM type, microprocessor MP providing, from the program stored in memory MM, control signals which pass via an amplifier AMP, to driving assembly EM.

Thus, via this arrangement, it is possible to program periods of time during which blocking member PV will prevent the sliding of bar B, even if a valid authorization signal orders the opening of the first lock S, i.e. by a key or another known opening code.

Consequently, by using this time lock SH, security is doubled, by preventing any unlocking of the safe or enclosure during one or more judiciously selected time periods, even by authorised personnel in possession of a key or another valid code.

However, if, after such a period of << ban on opening >>, the ban command is unintentionally maintained by a mechanical or electronic malfunction of the time lock, the opening of the door is, in this case, completely impossible, since blocking member PV of time lock SH physically impedes movement of bar B of the rod assembly.

This time lock SH and this blocking member PV are designed and positioned on door PO to be inviolable, thus inaccessible and indestructible, which prevents, a priori, even in this exceptional situation, any access and any reparation even by security teams.

Such malfunctions can be caused, either by failure, or by a breakdown in the electronics and/or the motor driving the blocking member.

Consequently, in order to have access to the protected enclosure, such malfunctions require that the enclosure is destroyed by breaching, for example the wall or a side of the enclosure, or by destroying the door.

In any event, it is necessary to damage the security enclosure, which is excessively expensive.

Moreover, in order to be able to breach such enclosure or to destroy the door, very specialised services or tools are required, which is also expensive.

Furthermore, these operations can require several hours or even days to be achieved. During this time, it is unfortunately not possible to have access to the interior of the enclosure to satisfy clients, in particular in the case of a bank.

Next and most of all, once the enclosure has been damaged, it must be repaired, so that the enclosure cannot be used during a certain period of time, i.e. for several days or weeks. This situation can be very detrimental in many applications.

For these reasons, it has been proposesd to associate with these time locks, a device allowing, via a special procedure, the operation of the time lock to be prohibited in the event of a breakdown or failure, in order to authorise movement of bar B of rod assembly TR and to allow the opening of door PO.

This type of device thus allows the time ban on opening imposed by time lock SH to be lifted.

A device of his type is also disclosed in the above mentioned EP Patent No 0 256 430.

In order to better grasp the structure of this device, the latter has also been shown very schematically in FIGS. 2*a* to 2*f*, in its characteristic operating positions.

This device D includes a lever 1 which can pivot and which is provided for co-operating with a beak 2 mounted on a barrel 4. Lever 1 can, in addition, co-operate with a stud G attached to blocking member PV which, in the position shown in FIG. 2*a*, is in the raised position for blocking bar B. It will be noted that blocking member PV is held in this position by a compression spring R which is supported by a stem TG driven by driving assembly EM (FIG. 1).

In this normal operating position, blocking member PV prevents movement of bar B, so that the door of the enclosure cannot be opened.

As is seen in FIG. 2*b*, member PV can be brought downwards, by lowering stem TG (arrow F1), by the action of driving assembly EM, to release the path of bar B and allow the door to be opened. In this lowered position of member PV, bar B can be withdrawn (arrow F2), in order to release bolts PT of rod assembly TR.

It is thus seen that in this operating mode, lever 1 and barrel 4 are not operative and they have no effect on the normal operation of time lock SH.

Barrel 4 carries a dowel-pin 6 which is associated with another prestressed compression spring, not shown; this assembly being housed in a blind hole arranged in barrel 4.

In the event of a breakdown or failure, an electronic circuit CE which is associated with a set of sensors, detects the failure and controls a second not shown driving assembly, which drives barrel 4 in rotation (FIG. 2*c*, arrow F3), via a gear train and a spring (not shown), this spring being provided for storing the driving energy provided by this driving assembly.

If bar B is in the position abutting blocking member PV (FIG. 2*c*), beak 2 will then abut bar B, the spring which drives barrel 4 then absorbing the driving energy provided by the corresponding driving assembly.

If after lock S has opened, the operator notes a malfunction of time lock SH, he moves bar B to its latching position, via the control hand wheel (FIG. 2*d*, arrow F4). Barrel 4 can then continue its rotation (arrow F5) to come to stop against a fixed stop 8.

In this position, dowel-pin 6 will engage in a recess 9 arranged in lever 1, which mechanically and irreversibly connects or couples barrel 4 to lever 1.

Since beak 2 is now in this position on the path of bar B, the operator by withdrawing this bar (FIGS. 2*e* and 2*f*, arrow F6) will push beak 2 which causes the rotation of barrel 4.

Thus, barrel 4 which is now connected in rotation to lever 1 via engagement of dowel-pin 6 in recess 9, causes lever 1 to pivot which will push stud G of blocking member PV (FIG. 2*e*), against the effect of spring R. It will be understood that because of the state of malfunction, stem TG has remained in the raised position and continues to push spring R against blocking member PV. Lever 1 will thus oppose the return force of spring R which is compressed.

Thus, by continuing to move bar towards its unlatched position, the operator can cause the release of member PV by retracting completely, due to lever 1 (FIG. 2*f*, arrow F7). The door can thus be opened.

This device allows the desired result to be obtained.

However, it has several drawbacks.

In order to set time lock SH and device D in operation again, barrel 4 must be separated from lever 1 and lever 1 must be brought into its initial rest position. This operation necessitates opening the lock and requires the intervention of a specialist, such intervention possibly requiring several days. During this time, the time lock is out of operation.

Moreover, given that it is the movement of bar B which allows the lock to be <<forced >> open, distinct batches of adapted locks must be provided, either for left opening doors (configuration shown in FIGS. 2*a* to 2*f*), or for right opening doors (not shown symmetrical configuration). This condition thus imposes manufacturing, assembly, administration and logistics for two types of locks, which increases the lock cost price.

Furthermore, these locks must be subjected to very precise adjustment during assembly, since bar B absolutely must come into contact with beak 2, to assure proper operation of the rescue lock.

In addition, the parts which form ban lifting device D must be of high quality. They must be able to overcome the force of compression spring R which tends to hold blocking member PV in its raised position.

Consequently, this device implements a significant number of parts which are difficult to make and adjust, so that it is relatively uneconomical.

SUMMARY OF THE INVENTION

An object of the present invention is to overcome these drawbacks by providing a device able to set into operation again and reset quickly and simply, without the intervention of a specialist, and without either opening or dismantling the lock.

A further object of the present invention is to provide a highly reliable device, of simple and inexpensive design, allowing the time lock with which it is fitted to be mounted indifferently on right and left opening doors.

The invention thus concerns a device for lifting, in particular in the event of a breakdown or failure, the ban on the opening of a conditional opening locking system, this device including:

driving means, a transmission member, a blocking member connected to the driving means via the transmission member and able to be actuated by the driving means to occupy an active position in which said member opposes movement of a bar, and an inactive position in which said member authorises movement of said bar, this device being characterised in that it includes de-activation means provided for freeing the transmission member and authorising release of the blocking member from its active position.

Other features and advantages of the invention will appear upon reading the detailed description which follows, made with reference to the annexed drawings which are given solely by way of example, and in which:

DESCRIPTION OF THE PREFERRED EMBODIMENT

With reference henceforth to FIGS. 3*a* to 3*d*, an embodiment of the device according to the invention will be described hereinafter, designated here by the general reference 10.

Figure 1:
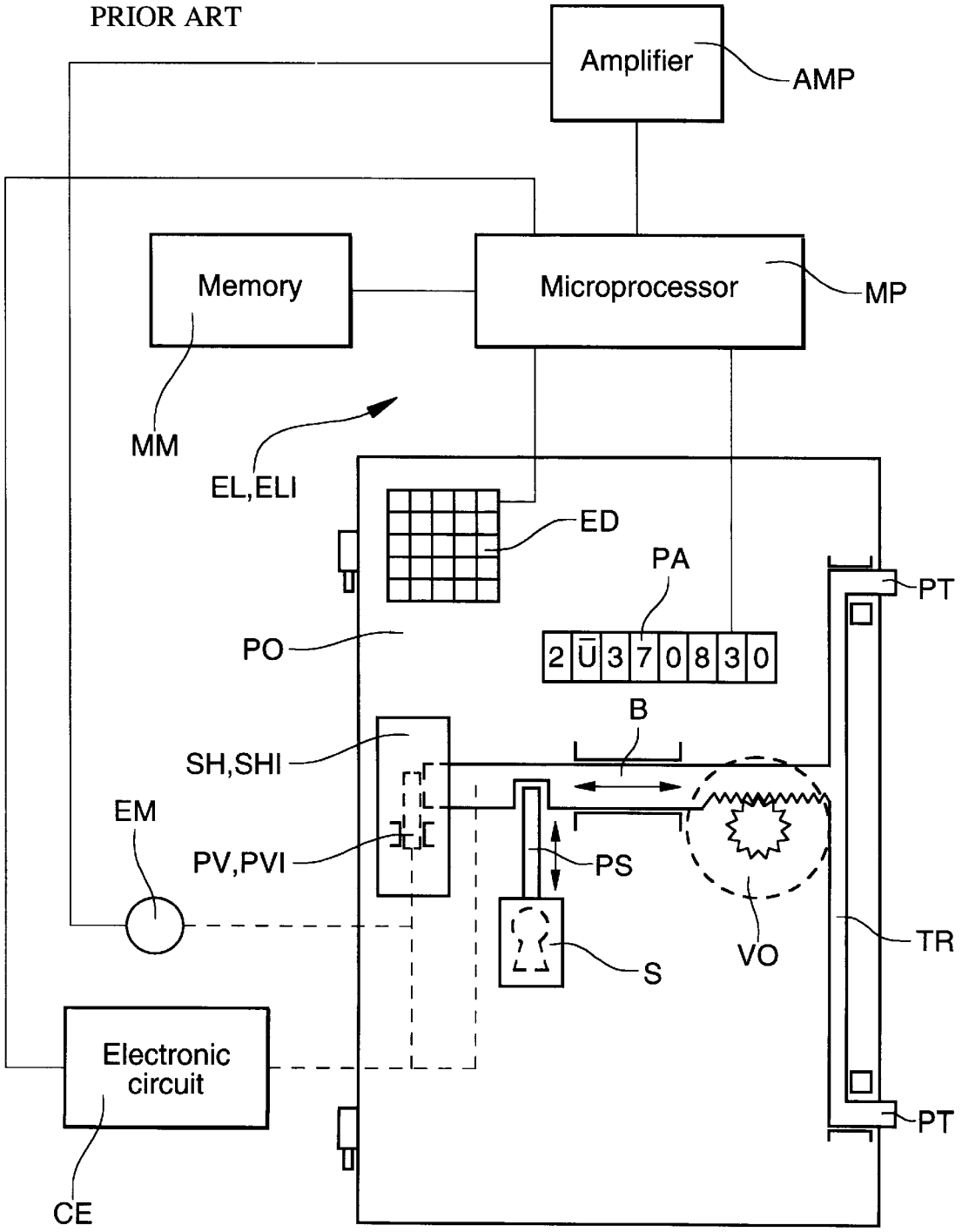
Fig. 1 PRIOR ART
FIG. 1 is a very schematic representation of a conventional security assembly in which a ban lifting device and a conditional opening locking system according to the invention, can be incorporated.
Figure 2A:
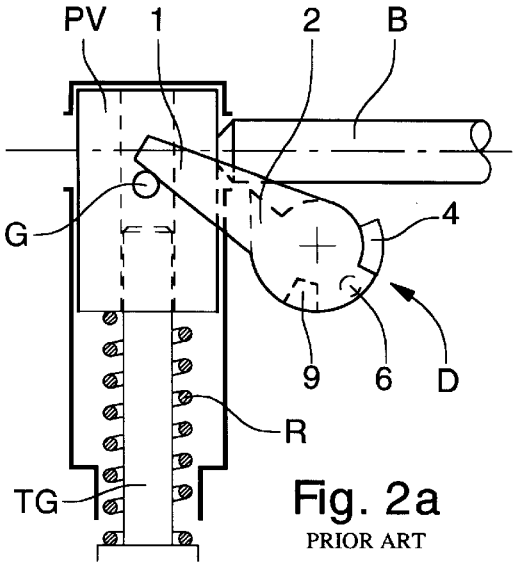
Fig. 2a PRIOR ART
FIGS. 2*a* to 2*f* show, in different operating positions, a ban lifting device of conventional structure, and which has been described in detail hereinbefore.
Figure 2B:
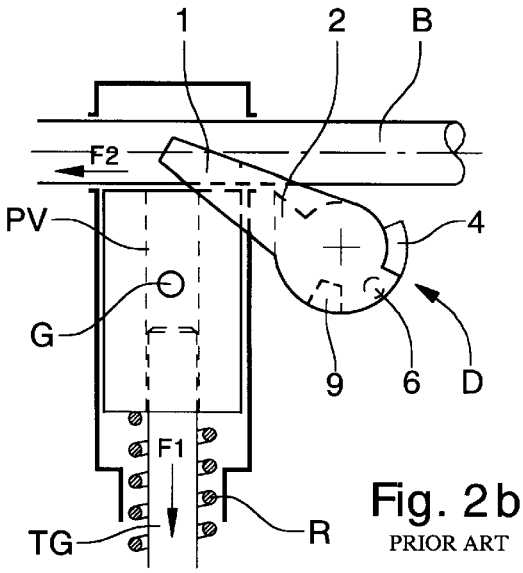
Fig. 2b PRIOR ART
Figure 2C:
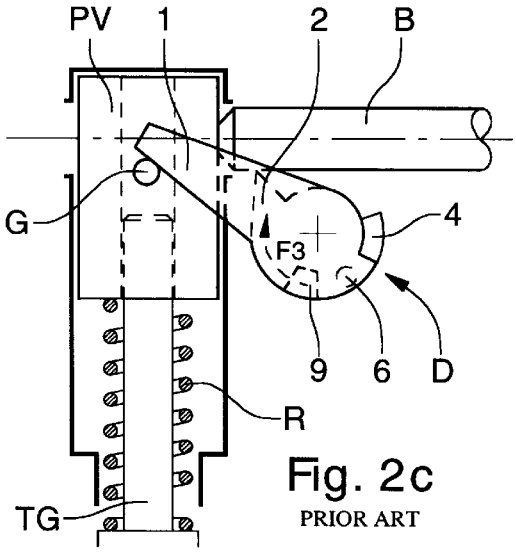
Fig. 2c PRIOR ART
Figure 2D:
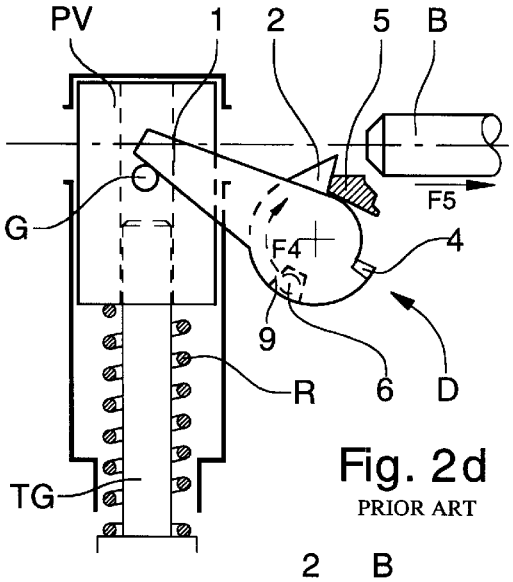
Fig. 2d PRIOR ART
Figure 2E:
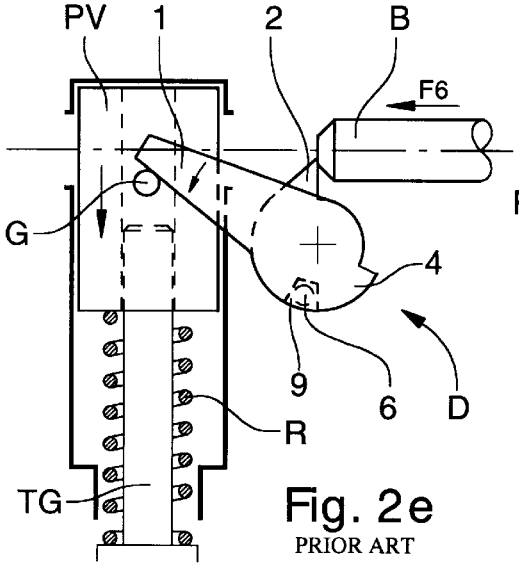
Fig. 2e PRIOR ART
Figure 2F:
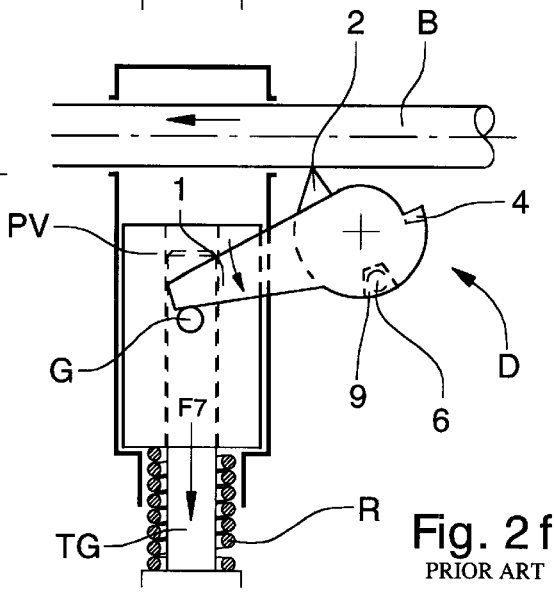
Fig. 2f PRIOR ART

Device 10 according to the invention is mounted in a frame 12 of a locking system SHI which is intended to fit a security assembly, such as that shown in FIG. 1.

It will be understood that locking system SHI fitted with device 10 is modified and greatly simplified.

Thus, locking system SHI according to the invention is intended to fit a security assembly of the same type as that described hereinbefore.

Locking system SHI according to the invention is thus also for blocking movement of a bar B in its unlatched position, for example during determined time periods, in which it has been decided to ban opening of the door PO (FIG. 1), in the same conditions as those explained hereinbefore.

The invention is thus described here in its application to a time lock, since the conditions for unlocking and locking the door are fixed as a function of determined programmed time periods.

It will be specified that this application is only given by way of example here and that the invention is not limited to this application. The invention can also apply to other types of lock for which the conditions for unlocking and locking are linked to other parameters than time or are linked, not solely to time parameters but also to additional parameters.

For this reason, locking system SHI is generically classified here as a <<conditional >> opening locking system.

However, application to a time lock constitutes a particular advantageous application which will form the preferred embodiment to which reference will be made in this description.

It is thus understood that device 10 allows a ban on opening, which has been imposed by said conditional opening locking system, to be lifted and cancelled. Device 10 will be called the <<lifting >> device.

Locking system SHI includes a blocking member PVI which, in this example, is a member of parallelepiped shape, able to slide between two characteristic respectively raised and lowered positions, by translating in a guide 14, formed of two parallel walls 16 and 18.

Member PVI is mounted in guide 14 with significant lateral operating plays allowing it to slide, without friction, between its two positions.

Figure 3A:
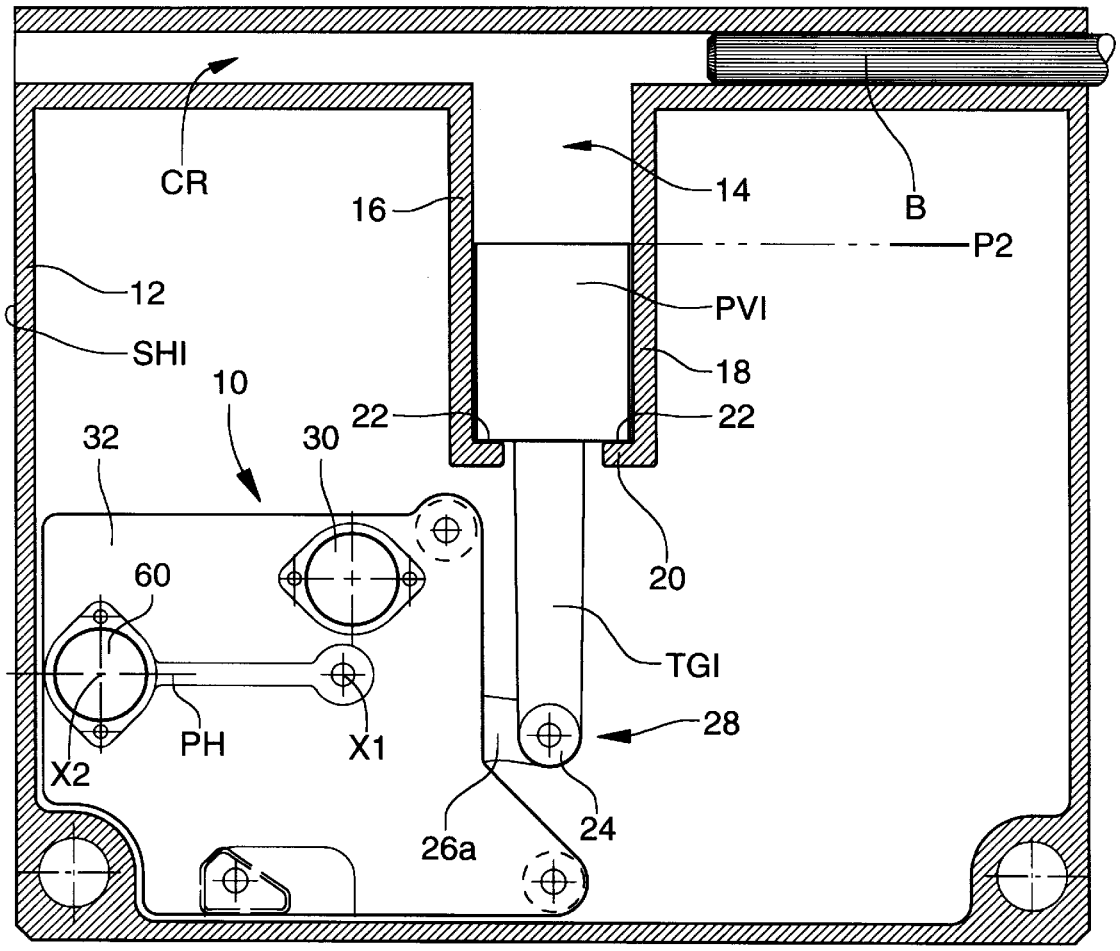
FIG. 3*a* is a front view of a device according to the invention, incorporated in the frame of a time lock and shown in a first characteristic operating position.
Figure 3D:
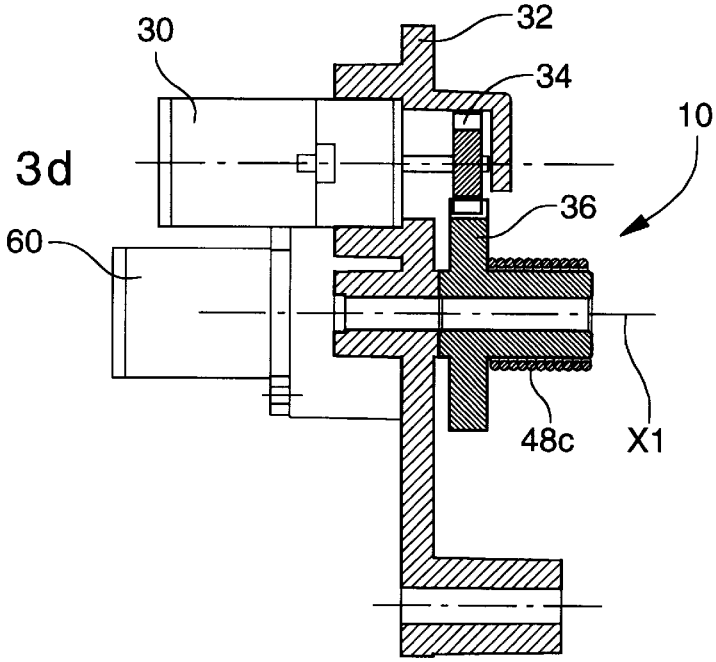
FIG. 3*d* is a cross-sectional view of the device according to the invention made along the line D—D of FIG. 3*b;*

Member PVI is shown in FIG. 3*a* in a lowered position in which it does not interfere with the movement of bar B of rod assembly TR (not shown here).

In this position, member PVI abuts against a stop 20 which is formed by shoulders 22 formed at the base of walls 16 and 18.

Bar B, as mentioned hereinbefore, can thus slide in a channel CR between its latching and unlatched positions, under the control of hand wheel VO (FIG. 1), in order to allow unlocking or locking of door PO by the play of bolts PT of rod assembly TR.

Figure 3B:
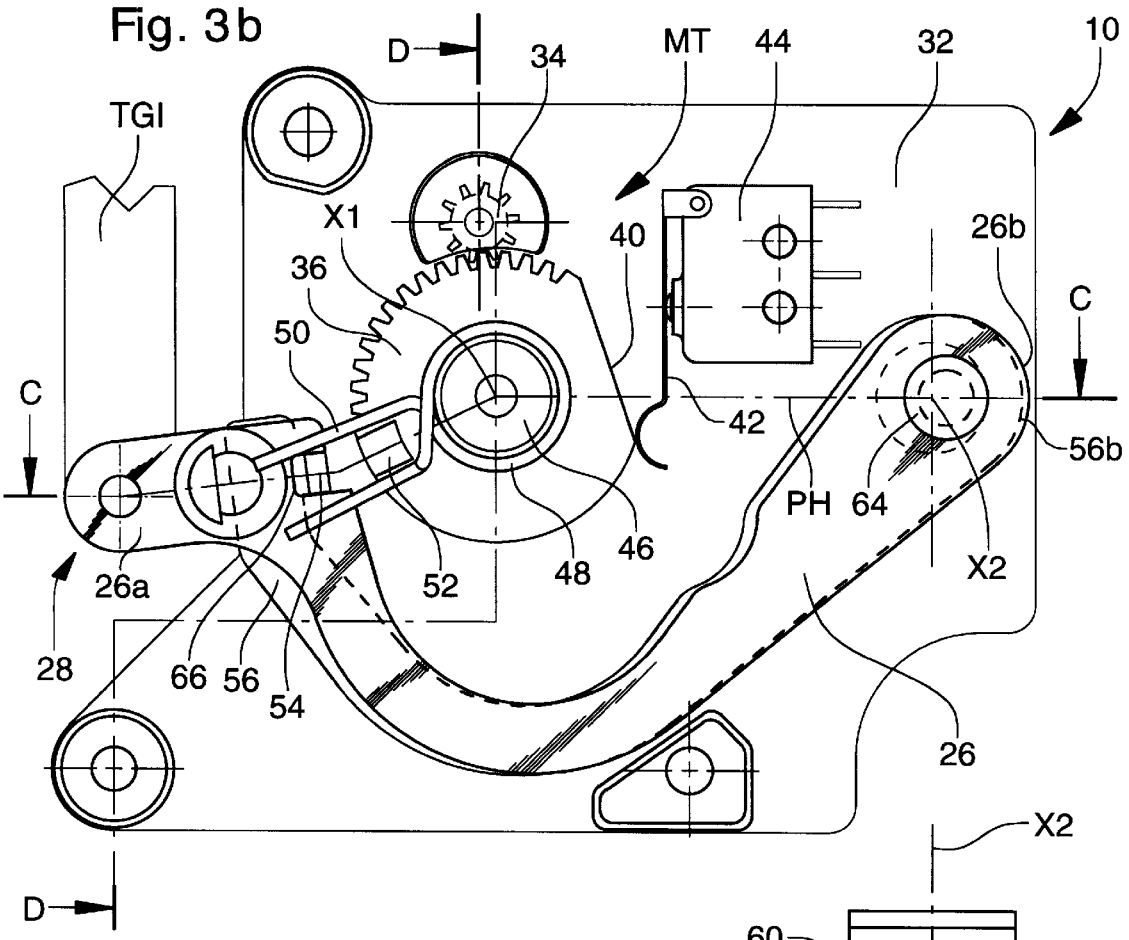
FIG. 3*b* is a rear view of the device of FIG. 3*a*, shown in the same position.

Blocking member PVI is, in this example, linked by a conventional articulation, which is not shown, to a stem TGI which is itself connected, by a articulation 24, to a first end 26*a* of a transmission arm 26 (FIG. 3*b*).

Transmission arm 26 is pivotally mounted by a second end 26*b* and it is coupled, in proximity to its first end 26*a*, to driving means MT.

Stem TGI and transmission arm 26 constitute a transmission member 28 which connects, mechanically, blocking member PVI to driving means MT and which assures transmission of the energy provided by driving means MT to blocking member PVI.

Driving means MT include an electric motor 30 which is energised and controlled by an electronic control unit ELI (FIG. 1).

Motor 30 is mounted on a plate 32 which is arranged to be able to be fixed, for example by screws, onto frame 12 of locking system SHI.

In this example, motor 30 is mounted on plate 32 on the opposite side to transmission arm 26. This motor 30 includes a driving shaft which is not referenced, at the end of which is provided a driving pinion 34 (FIG. 3*d*) which opens out, with respect to plate 32, on the side of arm 26, the side of the plate on which all the operating components of the device, which are intended to co-operate with each other and be set into motion, are situated.

Pinion 34 meshes with a driving wheel 36 on which is arranged a toothed sector meshed with the teeth of pinion 34. This wheel 36 is freely rotatably mounted on a shaft 38 (FIG. 3*c*) driven into plate 32.

Figure 4A:
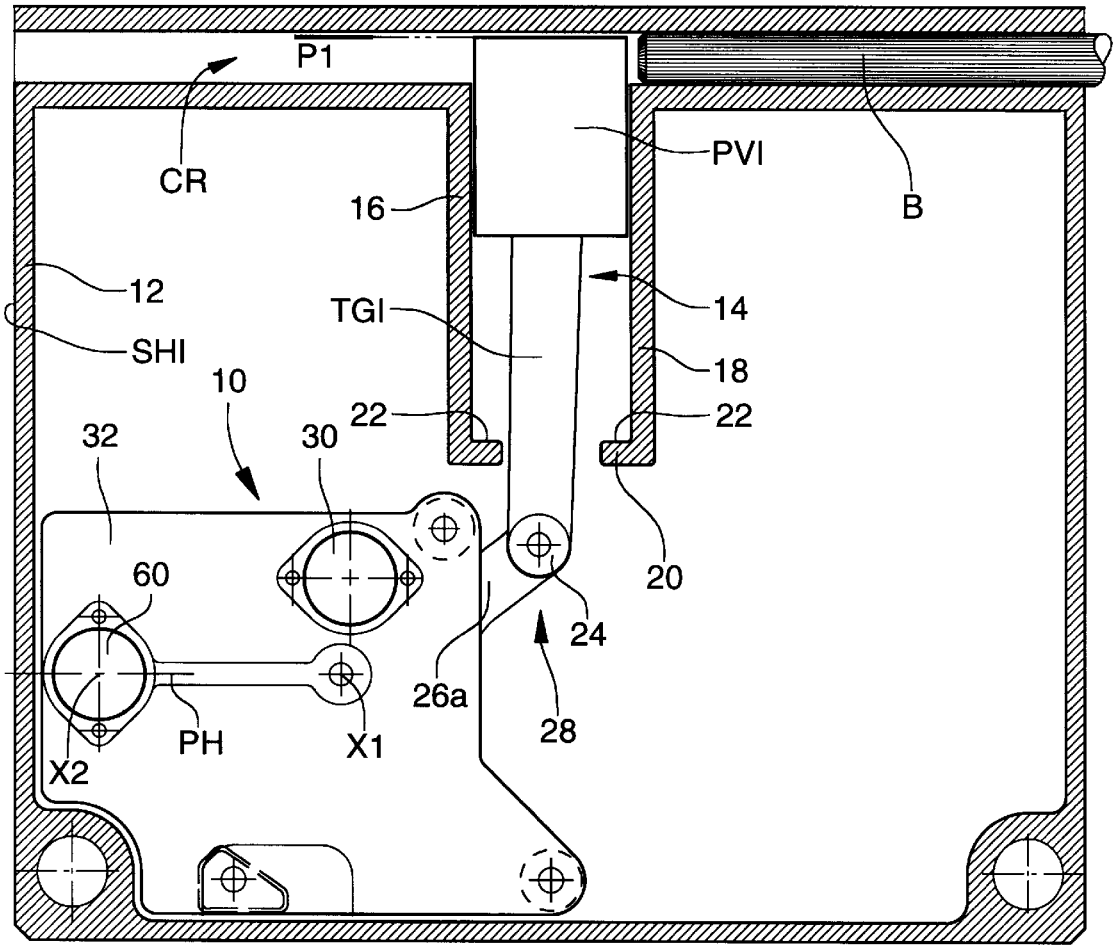
FIGS. 4*a* to 4*c*, 5*a* to 5*c* and 6*a* to 6*c* are similar views to FIGS. 3*a* to 3*c*, but showing the device according to the invention in other characteristic operating positions.

Wheel 36 also includes a flat portion 40 on which rubs a strip 42 of a position sensor 44 capable of providing signals representing the angular position of wheel 36 to electronic control unit ELI. It will be understood from the description which follows that, in a normal operating mode of device 10 corresponding to normal driving of member PVI, these signals are also representative of the raised and lowered position of member PVI, respectively called the active (referenced P1, FIG. 4*a*) and inactive (referenced P2. FIG. 3*a*) positions.

Position sensor 44 is, as such, a sensor of conventional structure and it will not be described here in more detail.

Wheel 36 further includes a sleeve 46 which extends perpendicularly from the body or board of wheel 36, and coaxially with its geometrical axis of rotation X1.

This sleeve 46 has an elongated cylindrical shape and it projects from the body of wheel 36, in the direction of frame 12. It will be noted that shaft 38 which supports wheel 36 in rotation passes through the body of wheel 36 and extends over the length of sleeve 46. It will also be specified that wheel 36 and sleeve 46 are made in a single piece, sleeve 46 and the body of wheel 36 consisting of a single piece and being made for example of synthetic material, such as polyoxymethylene which is usually designated by the abbreviation P.O.M.

A spring 48, called an coiled spring, is mounted around sleeve 46. This spring 48 has a body 48*c* formed of a helical winding having in this example several turns, body 48*c* being freely positioned around sleeve 46. This spring 48 further possesses two radial arms 50 and 51 which are provided for driving transmission member 28, as will become clear hereinafter.

The two arms 50 and helical body 48*c* of spring 48 are formed of a same elastic or resilient wire F. This wire can absorb bending stress and allows the two arms 50 and 51 to open, in certain driving situations of member PVI, then to revert to their original configuration, after elastic deformation.

In conformity with the representation of the device in these Figures, and with the superposed arrangement of these two arms 50 and 51, they are respectively designated the upper arm and lower arm.

Upper arm 50 is connected to a first turn 48*a* of body 48*c* (FIGS. 3*c* and 4*d*), this turn 48*a* abutting laterally against the board of wheel 36. The last turn 48*b* ends in proximity to the free end of sleeve 46. As is seen in FIG. 4*d*, wire F which forms spring 48 has a junction arm 53 which connects this last turn 48*b* to lower arm 51, and which returns said wire F towards lower arm 51 by extending along body 48*c*.

Thus, the two arms 50 and 51 are brought back in a substantially same plane parallel to the body of wheel 38, by a return portion of wire F.

It will be noted that the two arms 50 and 51 extend radially from sleeve 46, in substantially parallel directions, towards a catch 52 which projects from the board or body of wheel 36. Catch 52 is positioned at a radial distance from sleeve 46 and from axis of rotation X1 of said wheel. Catch 52 can thus provide driving torque to transmission member 28.

The two arms 50 and 51 of spring 48 extend on either side of this catch 52 and enclose or confine it.

Consequently, when wheel 36 is driven in rotation by motor 30, via pinion 34, it drives with it spring 48 and more particularly (in normal operation) its arms 50 and 51, catch 52 pushing upwards or downwards, clockwise or anticlockwise, one or other of arms 50 and 51, according to the rotational direction imposed on said wheel 36 by motor 30.

Thus, the setting in rotation of wheel 36 actuates arms 50 and 51 and causes the angular movement thereof which, in normal operation, is simultaneous.

Device 10 according to the invention further includes a finger 54 (see FIG. 6*b*) which projects, parallel to catch 52 and parallel to axis of rotation X1 of wheel 36.

The two arms 50 and 51 of spring 48 extend on either side of finger 54 and enclose and confine said finger 54 in the same manner as catch 52. Consequently, any rotational movement of wheel 36 in one direction or another pushes finger 54 upwards or downwards, via catch 52 and via arms 50 and 51 of spring 48. The rotation of wheel 36 thus has the function of causing, in normal operating mode, an upward or downward movement of finger 54, but with the interposition at this level of an elastic motion transmission member formed in this example by coiled spring 48.

Finger 54 is solid with an oscillating arm 56 which has a general shape substantially corresponding to that of transmission arm 26 and which is mounted adjacent to and juxtaposed with this transmission member.

Figure 4D:
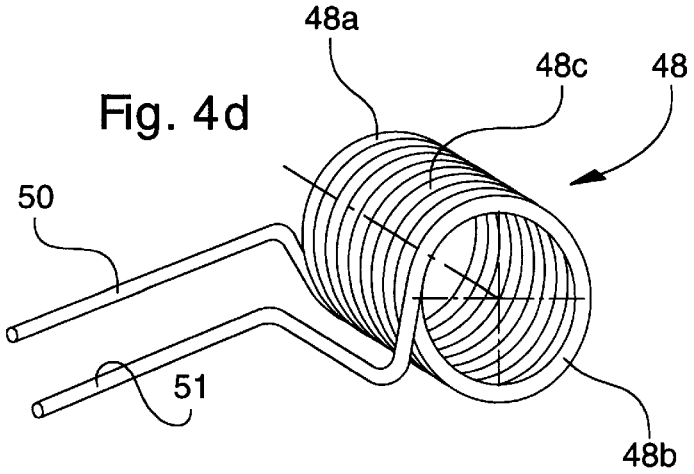
FIG. 4*d* is a perspective view of a coiled spring equipping the device according to the invention.
Figure 4B:
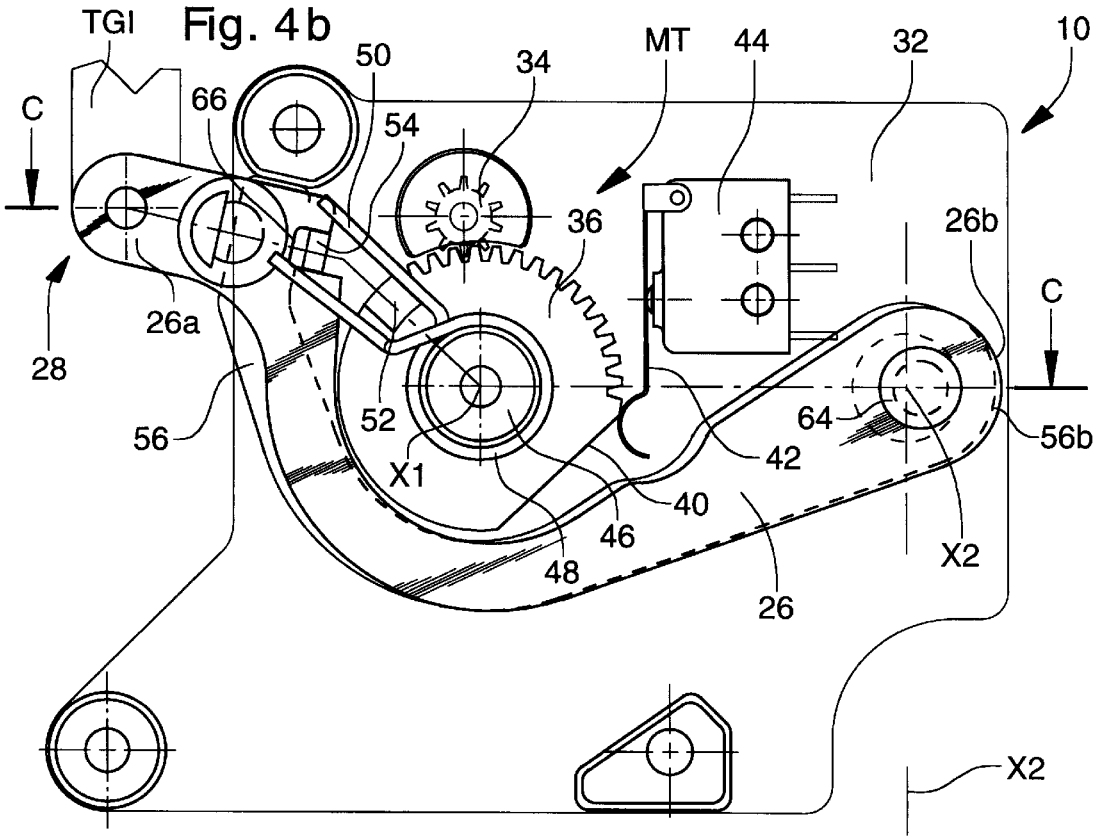
Figure 4C:
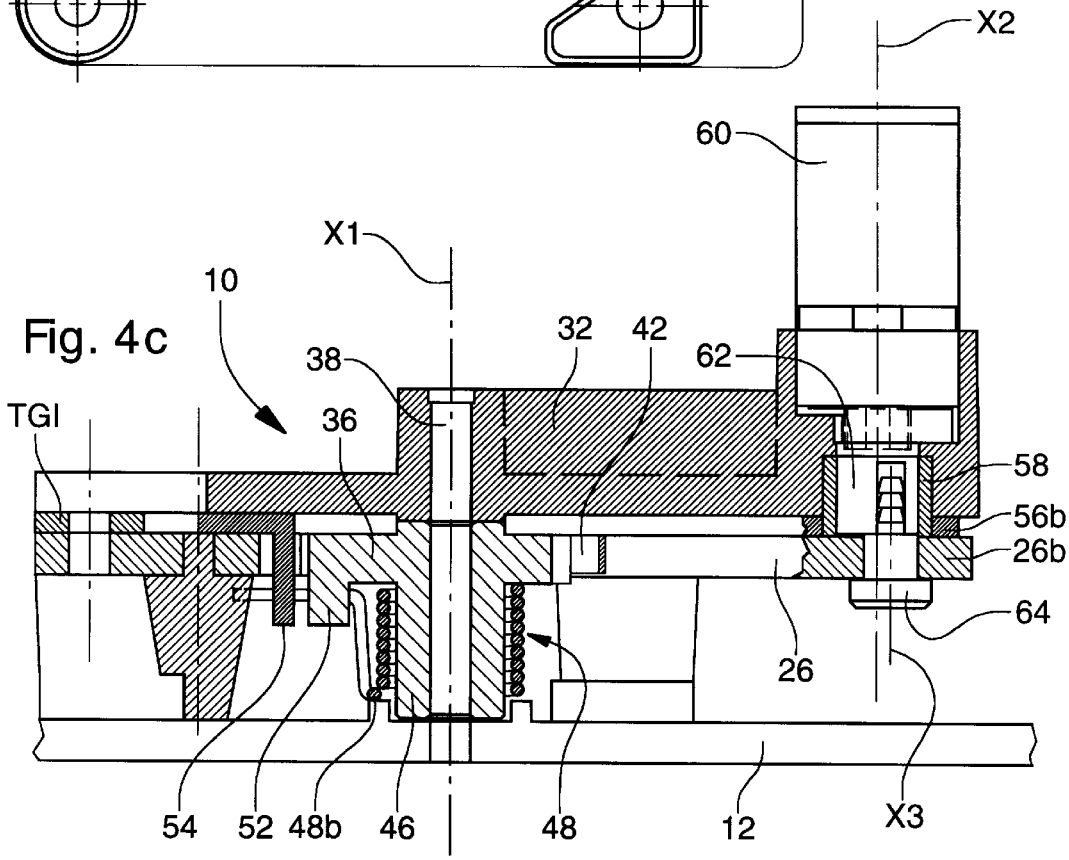
Figure 5A:
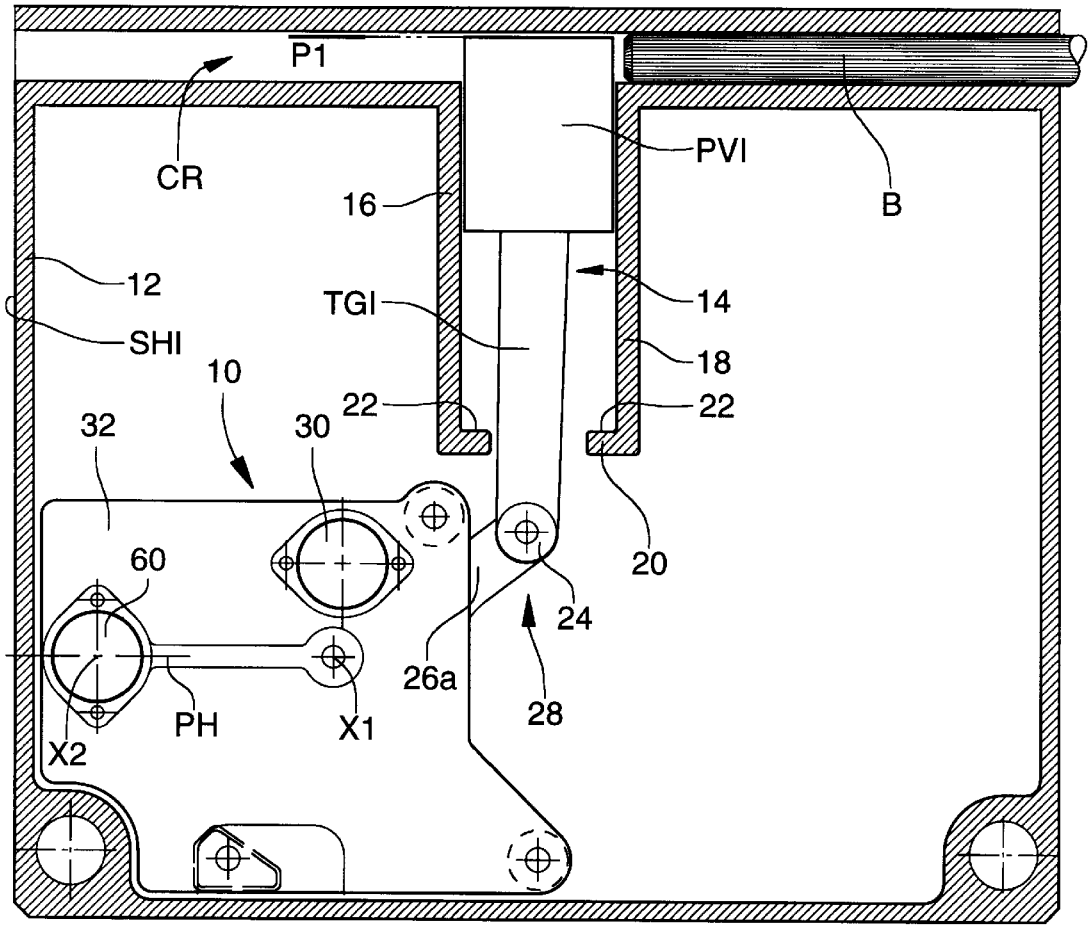
Figure 5B:
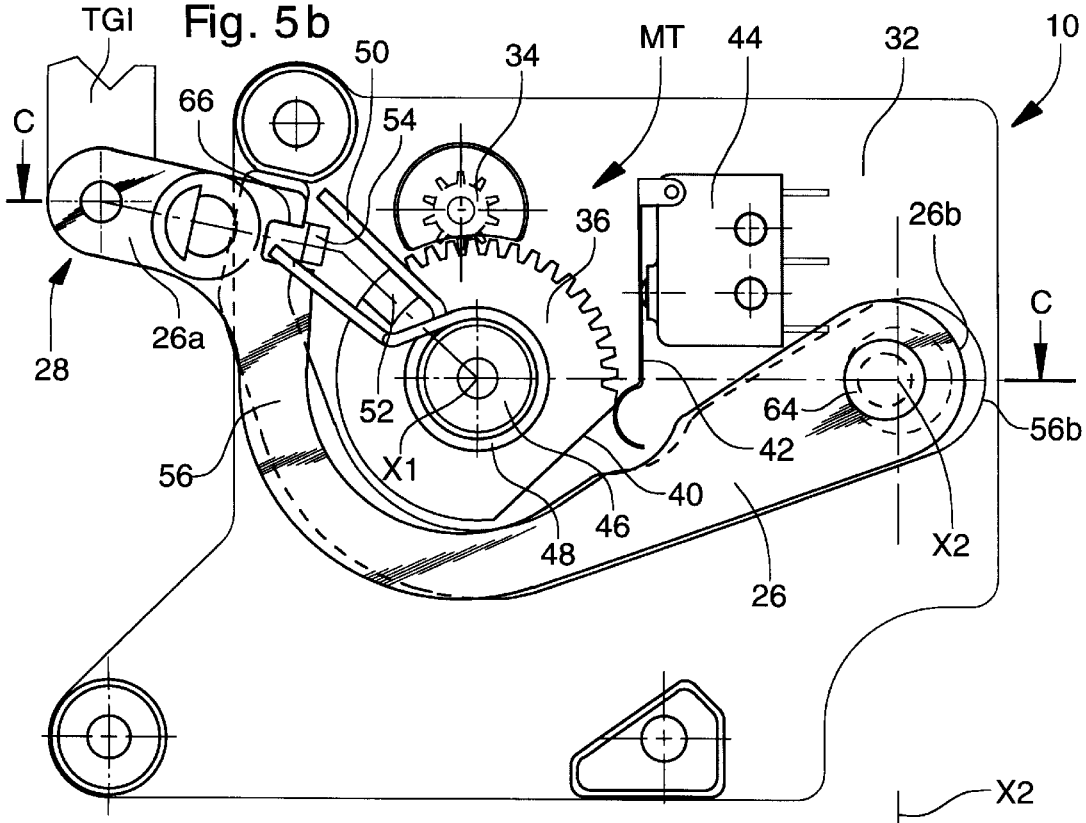
Figure 6A:
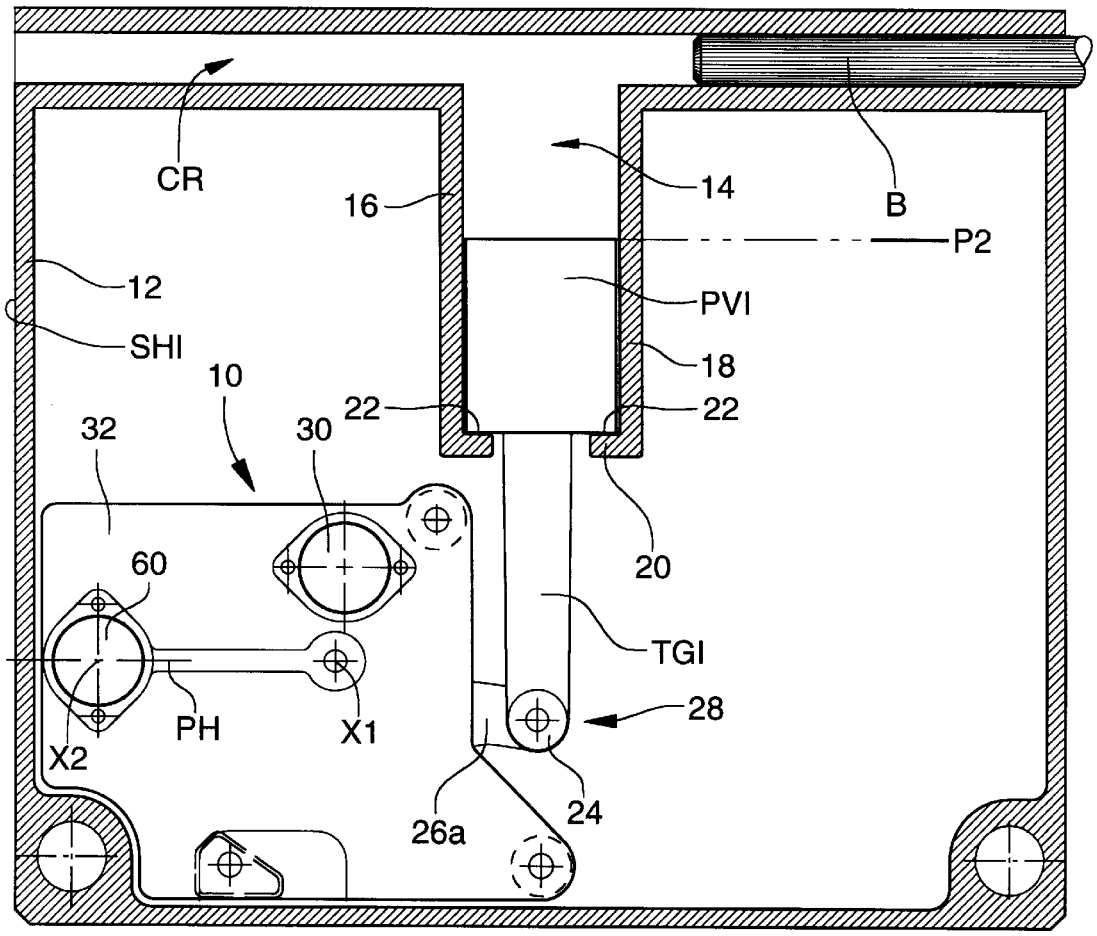
Figure 6B:
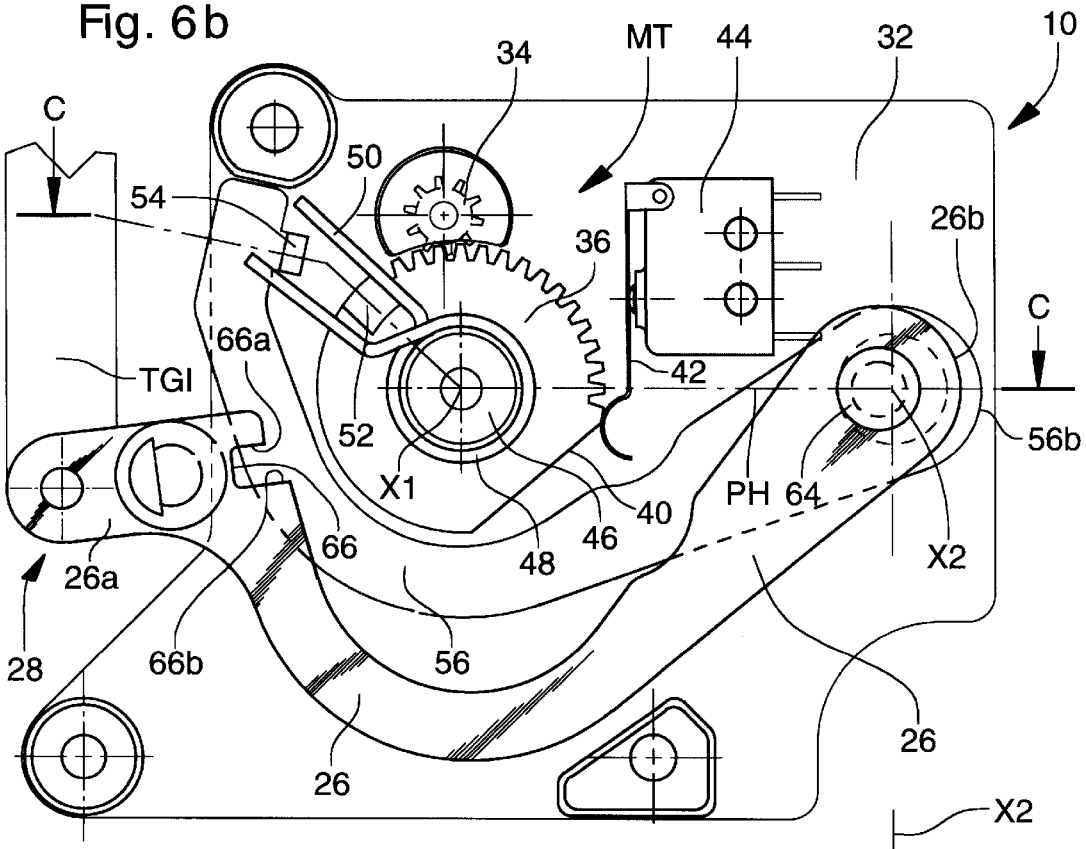
Figure 6C:
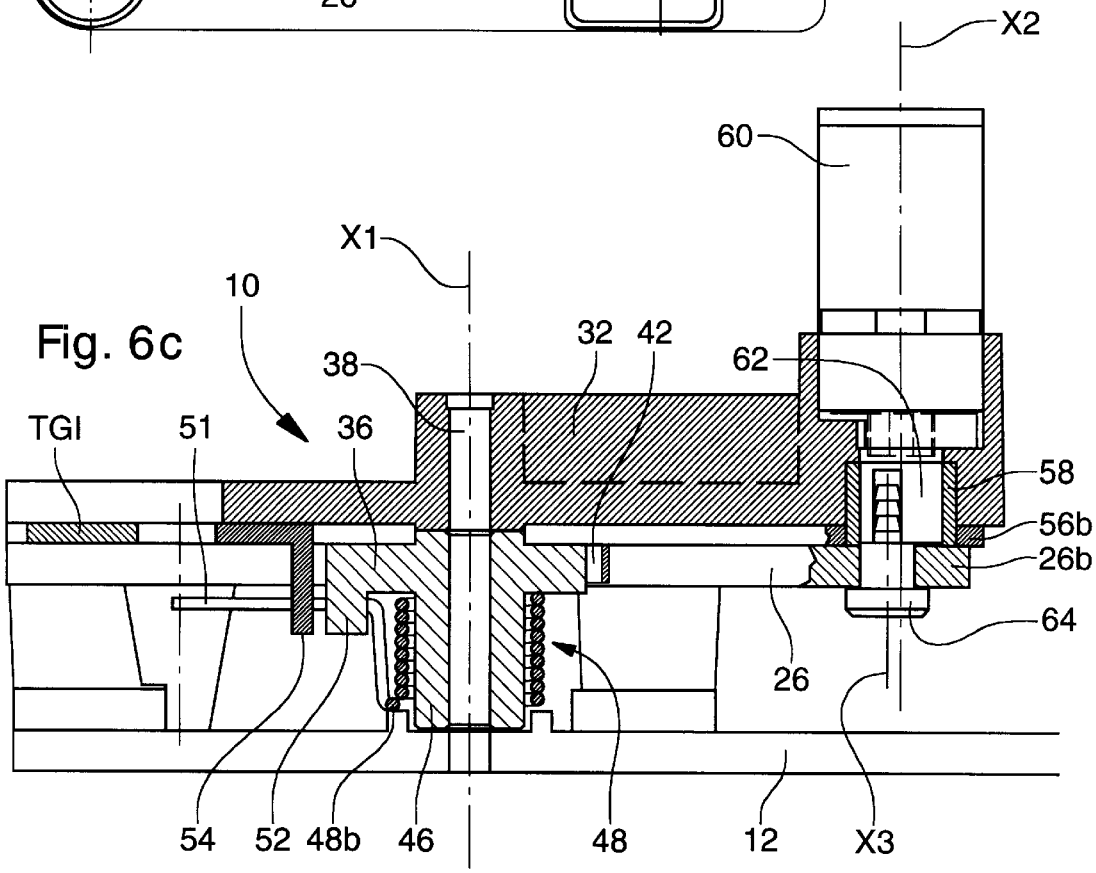

Oscillating arm 56, which is seen in detail in FIG. 6*b*, is formed like transmission arm 26 of an embossed metal plate of small thickness having in plane a <<J >> shape. The elbows of these two juxtaposed arms 26 and 56 allow the arms, when they are in the raised position, to come into the proximity of wheel 36 (see FIGS. 4*b*, 5*b* and 6*b*) and to carry their free ends above wheel 36.

This disposition provides a compact arrangement which offers an amplitude of movement allowing unit B to be brought into its two extreme positions P1 and P2.

Finger 54 is arranged at a first free end 56*a* of oscillating arm 56 and, in this example, it advantageously consists of a single piece with arm 56.

At its second end 56*b*, oscillating arm 56 is freely rotatably mounted about a sleeve 58 which projects from plate 32 and which is formed by a sleeve driven into said plate. Oscillating arm 56 can thus pivot freely about an axis of rotation X2 (FIG. 3*c*) which is parallel to axis of rotation Xl of wheel 36.

A second electric motor 60 (FIG. 3*d*), which is also driven by electronic control unit ELI, is mounted coaxially to this axis X2. This motor 60 is mounted on plate 32 on the same side as motor 30. This motor 60 is mechanically connected in rotation to a driving shaft 62 which is guided in sleeve 58 and which is positioned coaxially to axis of rotation X2.

As is seen in the Figures, the two axes of rotation X1 and X2 are positioned in a horizontal plane PH which corresponds here to the plane of cross-section C—C and which is perpendicular tot the direction of motion of member PVI.

A stud 64 with a head is driven into driving shaft 62. Stud 64 forms an axis of rotation X3, this stud 64 and this axis X3 being positioned on shaft 62 in such a way that axis X3 is offset laterally with respect to axis of rotation X2. It will be noted that, in this example, and in the two characteristic positions thereof (FIGS. 3*b*, 4*b*, 5*b* and 6*b*) axis X3 also extends in plane PH.

Thus, it will be understood that stud 64 is offset with respect to the axis of rotation of motor 60.

Figure 3C:
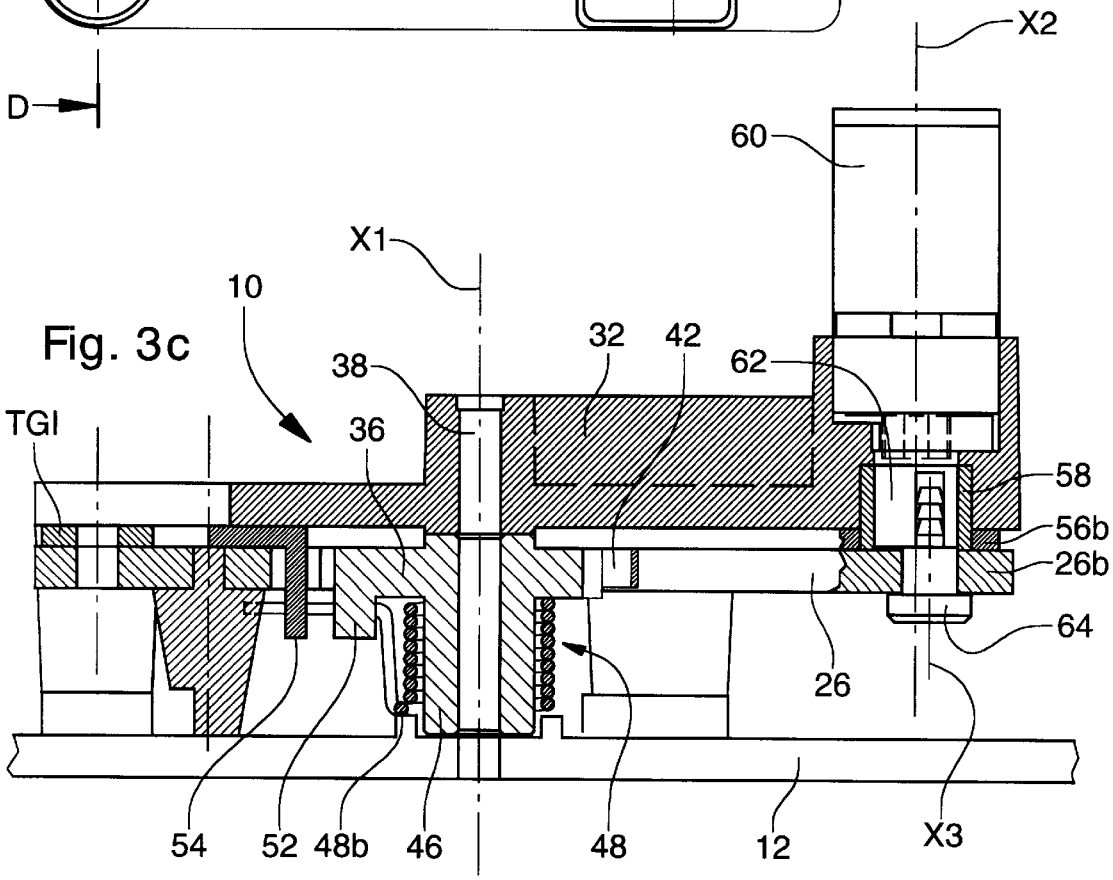
FIG. 3*c* is a cross-sectional view of the device according to the invention made along the line C—C of FIG. 3*b*.

As is seen in FIG. 3*c*, stud 64 supports and guides in rotation the end 26*b* of transmission arm 26. Transmission arm 26 can thus pivot freely about this stud 26 and about axis of rotation X3 which constitutes the axis of rotation of transmission arm 26 and which is consequently distinct, but close to axis of rotation X2 of oscillating arm 56. In this application, axis X2 is offset in plane PH by 1 mm ($10^{-3}$ meter) from axis X3.

Thus, as a result of this construction, end 26*b* of transmission arm 26 and axis of rotation X3 thereof can be moved laterally to the left or right, to occupy a first position called the latching position shown more particularly in FIGS. 3*a*, 3*b* and 4*a*, 4*b* or a second position called the unlatched position shown more particularly in FIGS. 5*a*, 5*b* and 6*a*, 6*b*.

This movement of end 26*b* of transmission arm 26 and its axis of rotation X3 is controlled by electric motor 60, as a result of the rotation of its shaft 62. Stud 64 thus constitutes, in this arrangement, an eccentric member assuring engaging and disengaging functions for transmission member 28, functions which will be explained in more detail hereinafter.

As is seen more particularly in FIG. 6*b*, transmission arm 26 includes a notch or straight groove 66 which is arranged (FIG. 3*a*) for accommodating finger 54.

Notch 66 is arranged in end 26*a* of arm 26 and it opens in the direction of opposite end 26*b* of said arm 26 and in the direction of finger 54. Notch or groove 66 extends, in a substantially parallel direction to plane PH.

Notch 66 can thus slide with play on finger 54, in a longitudinal direction, i.e. from left to right and vice versa. It is clear that this sliding is controlled by eccentric member 64 during the setting in rotation of the shaft of motor 60, which can pull or push transmission arm 26, either for bringing notch 66 onto finger 54 and allowing the engagement thereof (pulled position, FIG. 3*a* to 3*d* and 4*a* to 4*c*), or for moving said notch 66 away from finger 54 and allowing the disengagement thereof (pushed position, FIGS. 5*a* to 5*c* and 6*a* to 6*c*).

It is clear that the mechanical engagement of finger 54 in notch 66 assures the driving of transmission arm 26 by oscillating arm 56 which constitutes a driving element for transmission member 28.

Device 10 according to the invention includes at least two characteristic operating units, namely, on the one hand, driving means MT, and, on the other hand, transmission member 28.

In this embodiment example, driving means MT are formed by motor 30, pinion 34, wheel 36, catch 52, spring 48 and its two arms 50 and 51; oscillating arm 56 and its finger 54 which have also a driving function being coupled to driving means MT via spring 48.

Transmission member 28 is itself formed of stem TGI, articulation 24 and transmission arm 26. Notch 66 is thus arranged on transmission member 28. It is thus clear that blocking member PVI is linked to driving means MT via transmission member 28, via spring 48 which is inserted between said driving means MT and said transmission member 28.

Device 10 according to the invention is shown in FIGS. 3*a* to 3*d* and 4*a* to 4*c*, in a first characteristic configuration, wherein notch 66 is engaged on finger 54. In this configuration, shaft 62 is held blocked in a determined angular position by a not shown stop, and stud or eccentric member 64 is held in its right so-called engaging position (FIGS. 3*a*, 3*b*, 4*a* and 4*b*), transmission arm 26 being held by this eccentric member in the pulled position.

Thus, when electronic unit ELI orders the rotation of motor 30, wheel 36 rotates clockwise and lower arm 51 of spring 48 pushes finger 54 which moves oscillating arm 56, transmission arm 26 and thus the entire transmission member 28 upwards, to raise the blocking member in its active position P1 (FIGS. 4*a* to 4*c*) where it can impede the movement of bar B in channel CR.

Sensor 44 informs electronic unit ELI which deduces therefrom that member PVI is in its active position.

When the time ban on opening locking system SHI has elapsed, electronic unit ELI orders rotation of motor 30 in the opposite direction which, via the same means, brings member PVI downwards, into inactive position P2, the member resting abutting stop 20.

Sensor 44 again informs electronic unit ELI which deduces therefrom that member PVI is its inactive position and that bar B can be moved in channel CR for the opening of the door.

From this moment, the operator will thus be able to open door PO (FIG. 1) on condition of course that he has the necessary authorization(s) for ordering the opening of locking system S.

If electronic unit ELI causes the raising of member PVI at the beginning of a time period, while the bar is at the same time in channel CR facing guide 14 (the door is thus not yet latched), member PVI will abut against bar B. Motor 30 will however continue its rotation to end its ordered travel and spring 48 will open by the elastic spreading of the two arms 50 and 51 thereof. The information ordering the movement of member PVI to its active position P1 is << stored >> by spring 48. Member PVI will finish its travel as far as its active position P1, under the impetus of spring 48, when bar B will have been translated to the right, towards its latching position.

The same type of procedure is performed if bar B blocks member PVI in the raised position, while motor 30 has rotated wheel 36 anticlockwise to allow the return of member PVI downwards.

Arms 50 and 51 of spring 48 will also move apart while wheel 36 finishes its travel under the impetus of motor 30. When bar B is moved to the right, towards it latching position, member PVI will be brought back downwards by the action of spring 48 and, in this example, also by the combined action of gravity.

Thus, it is to be noted that in this arrangement, driving means MT are linked to blocking member PVI via spring 48 which forms an elastic connection between driving means MT and transmission member 28.

If sensor 44 informs electronic unit ELI that blocking member PVI is in active position P1 (FIGS. 4*a* to 4*c*), while the time ban on opening the locking system has passed, electronic unit ELI or another agent then notes that there is a breakdown or malfunction.

Figure 5C:
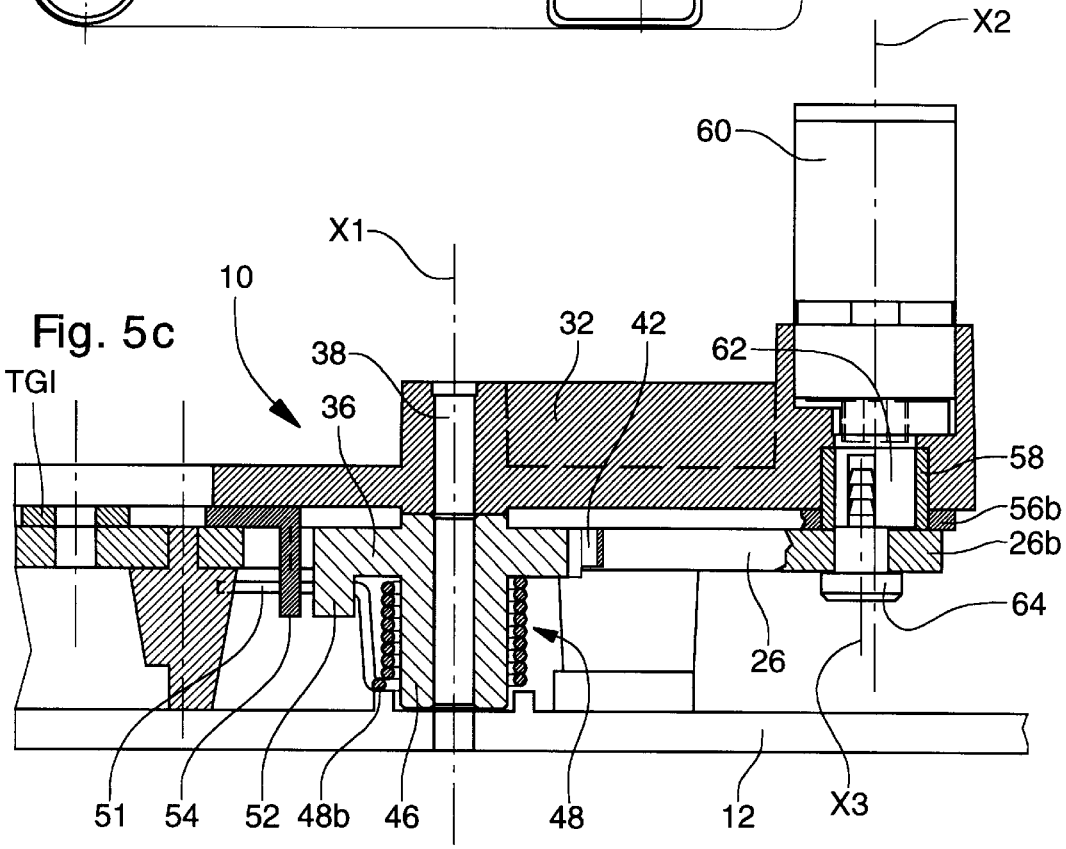

In these conditions, electronic control unit ELI orders rotation of motor 60 which will order the movement of eccentric member 64. This eccentric member 64 will move axis of rotation X3 of transmission arm 26 to the left and it will, consequently, push transmission arm 26 forwards. This configuration is shown in FIGS. 5*b* to 5*c*.

It will be noted that notch 66 is arranged, as a result of an appropriate length of its upper edge 66*a*, so that, when arm 26 has completed its disengaging travel, finger 54 is completely withdrawn from notch 66. Disengagement of transmission member 28 with regard to driving means MT is thus ordered via motor 60.

Consequently, and as is seen more particularly in FIG. 6*b*, transmission member 28 and in particular transmission arm 26 are thus freed from their coupling to driving means MT and allow, in this example by the simple effect of gravity, the return of blocking member PVI to its inactive position P2.

Bar B can be moved and door PO can thus be opened (FIG. 6*a*).

Consequently, it is understood from this description that this arrangement provides de-activation means which are arranged to release transmission member 28 in the event of a malfunction, such means authorising in this exceptional situation the release of blocking member PVI from its active position P1.

Transmission member 28 is thus made inoperative, since, suddenly, it no longer has any mechanical connection to driving means MT which no longer exert any stress on said member, nor on member PVI.

Also, de-activation means are provided for interrupting purely and simply the mechanical coupling between driving means MT and blocking member PVI, by causing the disengagement of notch 66 and finger 54, which allows blocking member PVI to return freely to its inactive position P2, in this example solely by the action of gravity. It is to be noted that transmission member 28 then pivots freely on plate 32.

More particularly, the de-activation means are formed by disengaging means which can uncouple, when so ordered, transmission member 28 from driving means MT, these means being formed by notch 66 and finger 54 and by the arrangement of one on transmission member 28 and the coupling of the other to driving means MT.

Furthermore, it will be understood that these disengaging means further include triggering means which are formed by eccentric member 64 and which act on the engagement of finger 54 in notch 66 to uncouple transmission member 28 from driving means MT. More particularly, these disengaging means cause the movement of notch 66 with respect to finger 54, the disengaging means openly acting on transmission member 28, by moving it with respect to finger 54, i.e. with respect to driving or oscillating arm 56.

In order to allow device 10 and locking system SHI to be set in operation again and to rearm said device, the rotation of motor 30, and in particular the rotation of wheel 36 anticlockwise, is ordered via electronic unit ELI. Oscillating or driving arm 56 is lowered until finger 54 abuts against a lower edge 66*b*of notch 66, an edge which is of greater length than that of upper edge 66*a*.

Finger 54 is in position to be able to be re-engaged in notch 66. At this moment, motor 60 is driven to pull transmission arm 26 and to re-engage notch 66 on finger 54. Device 10 is thus rearmed and the locking system can operate without having been unlocked. It will be noted that since these operations are performed by electromechanical means, they can be controlled integrally by electronic unit ELI which can itself be remote controlled, for example by telecommunication, from a monitoring centre.

Also in an advantageous manner, the invention thus includes activation means provided for making transmission member 28 operative again on demand, after it has been previously released by the de-activation means, in order to allow blocking member PVI to again occupy its active position P1, by being actuated by driving means MT. These activation means are provided for re-establishing the mechanical coupling between driving means MT and blocking member PVI, after said coupling has been interrupted by the de-activation means. It will also be specified that the activation means are formed by engaging means which are capable of coupling, on demand, transmission member 28 and driving means MT, after said coupling has been interrupted, these engaging means being formed by notch 66 and finger 54 which can be brought back into notch 66 by engaging means able, in particular, to re-engage finger 54 in said notch 66 in order to again couple transmission member 28 and driving means MT.

Also, the engaging means are provided for acting on transmission member 28, by moving it with respect to finger 54, these engaging means being formed by eccentric member 64 and driving system 60 which, by rotating the eccentric member, causes the movement of transmission member 28 to again engage notch 66 on finger 54.

It is clear from the foregoing that in this arrangement, lifting device 10 and driving means MT which normally assure the raising and lowering of blocking member PVI, are operationally and structurally associated, by being mounted on a same plate. More particularly, the de-activation and activation means, the disengaging means and the engaging means and the disengaging means and the engaging means are integrated in a same unit, i.e. on the plate.

What is claimed is:

1. A device for lifting a ban on the opening of a conditional opening locking system, this devise including:

driving means, a transmission member, a blocking member coupled to the driving means by the transmission member and able to be actuated by the driving means to occupy an active position in which said member opposes the movement of a bar, and an inactive position in which said blocking member authorises the movement of the bar, said device further including de-activation means for interrupting the coupling between the driving means and the blocking member, thereby freeing the transmission member and authorising release of the blocking member from said active position.

2. A device according to claim 1, wherein the de-activation means are provided for allowing the blocking member to return freely to said inactive position by the action of gravity.

3. A device according to claim 1, wherein the de-activation means include disengaging means provided for uncoupling, on demand, the transmission member from the driving means.

4. A device according to claim 3, wherein the disengaging means include a notch and a finger one of which is provided on the transmission member while the other is coupled to the driving means, the finger being engaged in the notch for driving the transmission member by the driving means.

5. Device according to claim 4, wherein the disengaging means further include triggering means acting on the engagement of the finger in the notch, these triggering means being provided for interrupting the engagement of the finger in the notch and for uncoupling the transmission member from the driving means.

6. A device according to claim 5, wherein the disengaging means are provided for causing the movement of the notch with respect to the finger.

7. A device according to claim 4, wherein the notch is arranged on the transmission member.

8. A device according to claim 5, wherein the disengaging means are provided for acting on the transmission member by moving the transmission member with respect to the finger.

9. A device according to claim 5, wherein the disengaging means are formed by an eccentric member which has an axis with respect to which the transmission member is rotatably mounted.

10. A device according to claim 9, wherein said eccentric member is coupled to a driving system, which, by rotating the eccentric member, moves the position of the axis and causes the movement of the transmission member to release the notch from the finger.

11. A device according to claim 10, wherein said driving system is formed by an electric motor.

12. The device according to claim 1, further including activation means provided for making the transmission member operative, on demand, after the transmission member has been freed by the de-activation means, in order to allow the blocking member to occupy said active position again, by being actuated by the driving means.

13. A device according to claim 12, wherein the activation means are provided for re-establishing the coupling between the driving means and the blocking member, after said coupling has been interrupted by the de-activation means.

14. A device according to claim 3, wherein the activation means include engaging means provided for coupling, on demand, the transmission member and the driving means, after said coupling has been interrupted, and wherein the activation means are provided for re-establishing the coupling between the driving means and the blocking member, after said coupling has been interrupted by the de-activation means.

15. A device according to claim 4, wherein the activation means include engaging means provided for coupling, on demand, the transmission member and the driving means, after said coupling has been interrupted, and wherein the engaging means are formed by the notch and the finger which can be brought back into the notch by the engaging means able to re-engage said finger in said notch in order to couple the transmission member and the drive means again.

16. A device according to claim 15, wherein the engaging means are provided for acting on the transmission member, by moving the transmission member with respect to the finger.

17. A device according to claim 10, wherein the engaging means are formed by the eccentric member and the driving system which, by rotating the eccentric member, causes the movement of the transmission member to re-engage the notch on the finger, and wherein the engaging means are formed by the notch and the finger which can be brought back into the notch by the engaging means able to re-engage said finger in said notch in order to couple the transmission member and the driving means again.

18. A device according to claim 1, wherein the driving means are connected to the blocking member by a spring assuring an elastic connection between the driving means and the transmission member.

19. A device according to claim 18, wherein the spring is formed by a helical spring positioned around a sleeve of the driving means and including two radial arms provided for driving the transmission member.

20. A device according to claim 19, wherein the disengaging means include a notch and a finger one of which is provided on the transmission member while the other is coupled to the driving means, the finger being engaged in the notch for driving the transmission member by the driving means, wherein the arms of the spring confine the finger.

21. A device according to claim 18, wherein the driving means include a catch allowing the spring to be driven in rotation by the driving means.

22. A device according to claim 9, which includes an oscillating arm rotatably mounted and carrying the finger, said arm being mounted adjacent to the transmission member.

23. A device according to claim 1, which includes a stop which is provided for limiting the movement of the blocking member in said active position.

24. An application of the device according to claim 1 to a conditional opening locking system.

* * * * *